US006494010B1

(12) United States Patent
Brandon et al.

(10) Patent No.: US 6,494,010 B1
(45) **Date of Patent: *Dec. 17, 2002**

(54) WIND RESISTANT ROOFING SHINGLE

(75) Inventors: Ralph Edwin Brandon; Carla A. Miller, both of Newark; Margaret M. Woodside, Pickerington, all of OH (US)

(73) Assignee: Owens Corning Fiberglas Technology, Inc., Summit, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 9 days.

(21) Appl. No.: 09/504,574

(22) Filed: Feb. 15, 2000

(51) Int. Cl.[7] ..... E04C 3/00
(52) U.S. Cl. ..... 52/578; 52/518; 52/57
(58) Field of Search ..... 52/518, 57

(56) References Cited

U.S. PATENT DOCUMENTS

| | | | | | |
|---|---|---|---|---|---|
| 1,295,361 | A | | 2/1919 | Overbury | |
| 2,393,379 | A | | 1/1946 | Jones | |
| 4,434,589 | A | | 3/1984 | Freiborg | |
| 4,835,929 | A | * | 6/1989 | Bondoc et al. | 52/518 |
| 5,094,042 | A | * | 3/1992 | Freborg | 52/57 |
| 5,247,771 | A | | 9/1993 | Poplin | |
| 5,271,201 | A | * | 12/1993 | Noone et al. | 52/518 |
| 5,295,340 | A | | 3/1994 | Collins | |
| 5,365,711 | A | * | 11/1994 | Pressutti et al. | 52/518 |
| 5,375,388 | A | | 12/1994 | Poplin | |
| 5,377,459 | A | | 1/1995 | Freiborg | |
| 5,419,941 | A | | 5/1995 | Noone et al. | |
| 5,467,568 | A | | 11/1995 | Sieling | |
| 5,575,876 | A | | 11/1996 | Noone et al. | |
| 5,676,597 | A | | 10/1997 | Bettoli et al. | |
| 5,822,943 | A | | 10/1998 | Frankoski et al. | |

* cited by examiner

*Primary Examiner*—Carl D. Friedman
*Assistant Examiner*—Steve Varner
(74) *Attorney, Agent, or Firm*—Inger H. Eckert; James J. Dottavio

(57) ABSTRACT

A hip and ridge shingle includes a base sheet having colored granules adhered to the top surface. A chip is adhered to the base at the trailing edge of the base sheet. A sealant bead is provided parallel to and adjacent the leading edge of base sheet.

23 Claims, 6 Drawing Sheets

WIND RESISTANT ROOFING SHINGLE

FIELD OF THE INVENTION

The present invention relates to a roofing shingle and more particularly to a shingle used in a peak or valley for a high wind application.

BACKGROUND OF THE INVENTION

U.S. Pat. No. 4,835,929 to Bondoc ('929 patent) provides a roofing hip and ridge shingle. The Bondoc shingle is a laminated design to provide a shingle with a three-dimensional effect. As a hip or ridge shingle, the Bondoc shingle is used on a roof at the intersection of two sloping sides of the roof, the roof forming a ridge or valley thereat. While the Bondoc design provides a laminated dimensional effect, the panels 2 and riser strips 4 are adhered only within a restricted lamination area between dotted lines 6 and 6' as shown in FIG. 1, of the '929 patent, thereby enabling the shingle to bend over the ridge or in the valley. Thus, the exposed portion of the hip is not laminated, and the non-laminated layers are therefore exposed to the atmosphere, which could cause the shingle to lift off in certain high wind situations.

U.S. Pat. No. 5,271,201 to Noone, et al. ('201 patent) provides another dimensional hip or ridge shingle. Noone laminates each layer on only one side 17 and uses a release tape 21 on the other side 18, so the layers may slide relative to one another during installation over a ridge or in a valley. The release tape 12 is removed after the shingle is bent, so the layers may adhere at installation. This reduces the non-laminated exposed portion discussed above with respect to Bondoc, but increases cost and effort to install the shingles. Furthermore, the leading edge 27 of the shingle is not laminated, and in a similar manner to Bondoc, the non-laminated exposed portion at the leading edge may experience lift off in high wind situations.

It would be desirable to provide an improved hip or ridge shingle adapted for easy installation and providing improved performance in high wind situations.

SUMMARY OF THE INVENTION

Accordingly, the present invention provides an improved hip or ridge shingle adapted to provide improved high wind performance.

A hip and ridge shingle according to the present invention includes a base sheet having a leading edge and a trailing edge and colored granules adhered to the top surface. A chip is adhered to the base sheet at the trailing edge of the base sheet. A sealant bead is provided on the base sheet parallel to and adjacent the leading edge thereof. The sealant bead adheres adjacent shingles to prevent the shingles from lifting off during high wind situations.

DETAILED DESCRIPTION OF THE PREFERRED EMBODIMENTS

Figure 1:
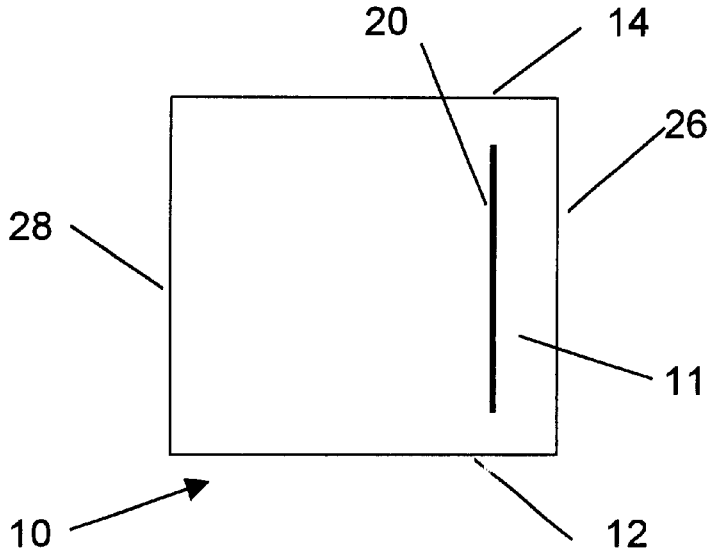
Fig. 1 Prior Art
FIGS. 1 and 1A are plan views of a prior art hip and ridge shingle.
Figure 1A:
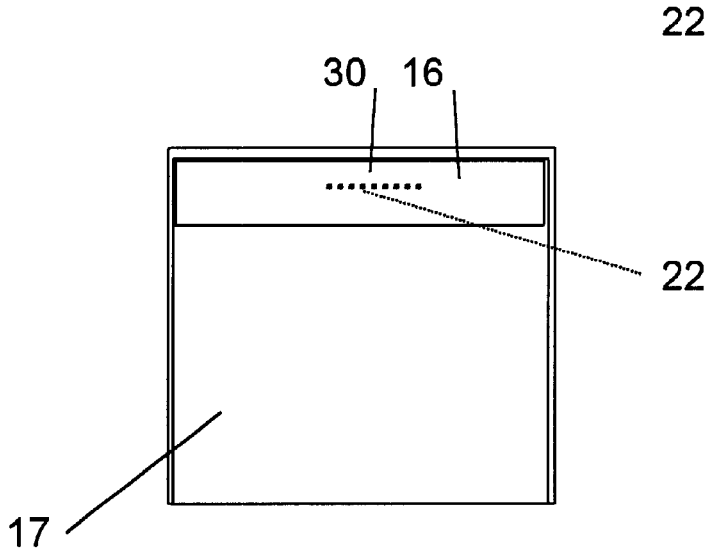
Fig. 1A Prior Art
Figure 2:
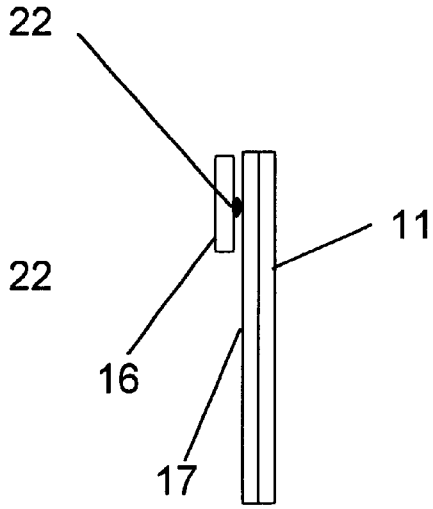
Fig. 2 Prior Art
FIG. 2 is a side view of the prior art shingle shown in FIG. 1A.

As shown in FIG. 1, a hip and ridge shingle 10 includes a base sheet 11, which may be alternately referred to as a panel. The shingle 10 includes a leading edge 12 and a trailing edge 14. To achieve a dimensional look, a number of chips or panels are adhered to the base sheet, 11 as is shown in FIGS. 1A and 2. A first panel 17 (not shown in FIG. 1), substantially coextensive with the base sheet 11, is adhered to the base sheet along one side 26 thereof using a bead 20 of adhesive. Because the first panel 17 is adhered to only one side 26 of the base sheet 11, the first panel 17 is able to slide relative to the base sheet 11 when the shingle is bent over a ridge as described above with reference to Noone. The first panel 17 is adhered to the base sheet 11 using a first adhesive bead 20, which is applied to the top surface of the base sheet 11 adjacent the side 26 prior to installing the first panel 17 to the base sheet 11.

Figure 14:
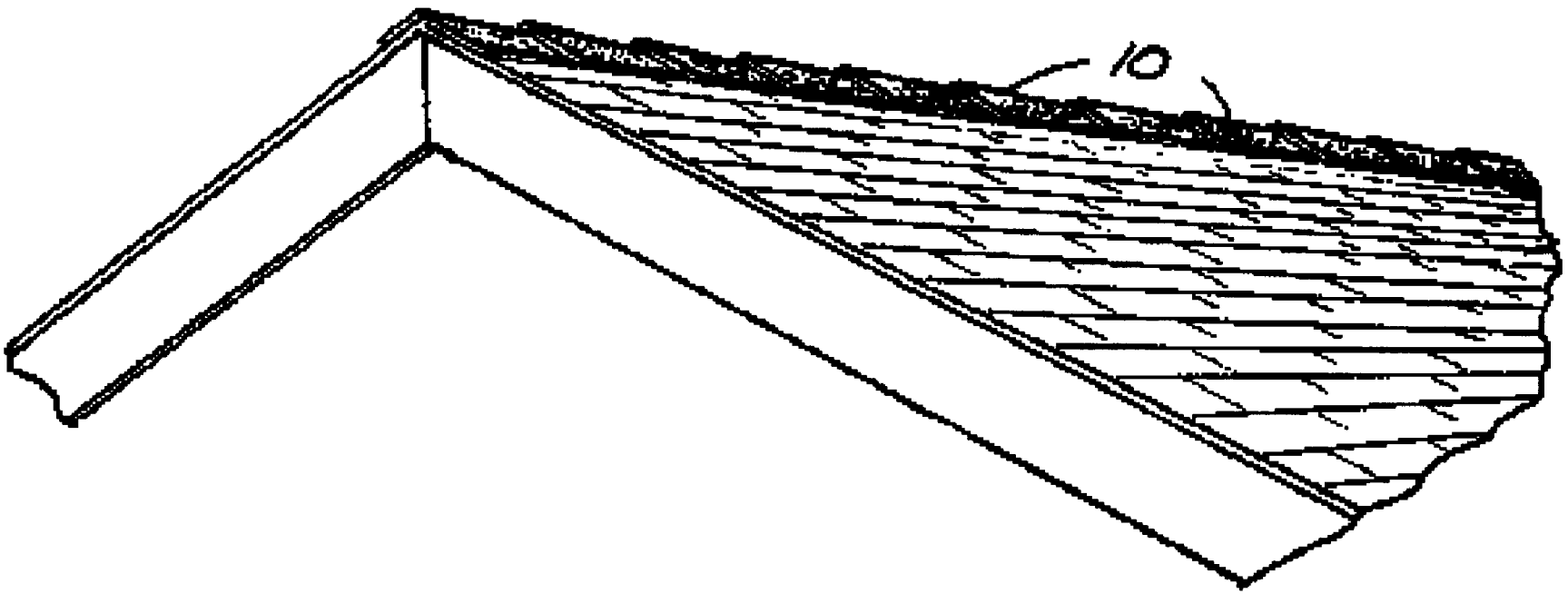
FIG. 14 is an isometric view of a roof having a shingle according to the present invention.

A second bead of adhesive 22 is applied to the upper surface of the first panel 17 adjacent the trailing edge 14 and parallel thereto. A second chip 16 is thereby secured to the first panel 17, as described in Bondoc '929, securing the chip 16 in a central portion thereof to permit bending of the shingle 10. As used herein, "chip" may alternately be referred to interchangeably as "riser". When installed on the roof, each shingle 10 is applied with the leading edge 12 applied toward the downward sloping portion of the roof, or along a ridge as shown in FIG. 14. The chip 16 is positioned at what will be referred to as the "top" edge of the shingle 10. Each shingle is then nailed through the chip 16, through panel 17 and base sheet 11 and to the roof structure.

The next shingle 10 is applied over a portion of the first shingle such that the leading edge 12 of the second shingle overlaps the chip 16 of the previously installed shingle. Therefore, the chip 16 in conjunction with panel 17 and base sheet 11 create a three dimensional effect at the bottom edge of the adjacent shingle 10.

Figure 3:
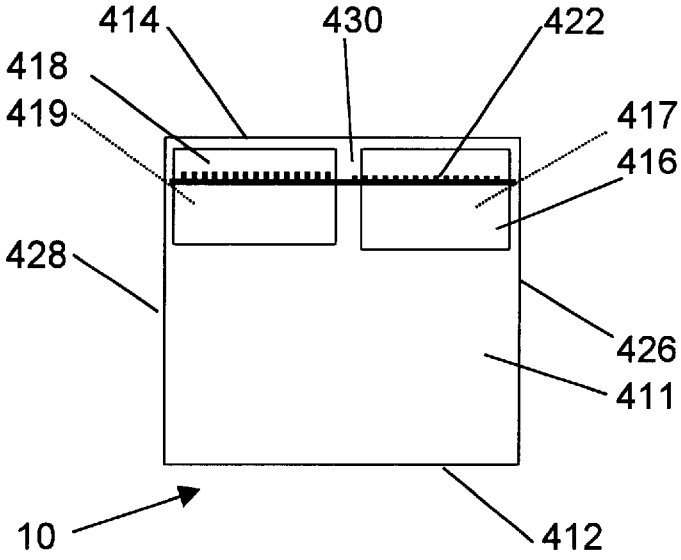
FIG. 3 is a plan view of an improved hip and ridge shingle according to the present invention.
Figure 5:
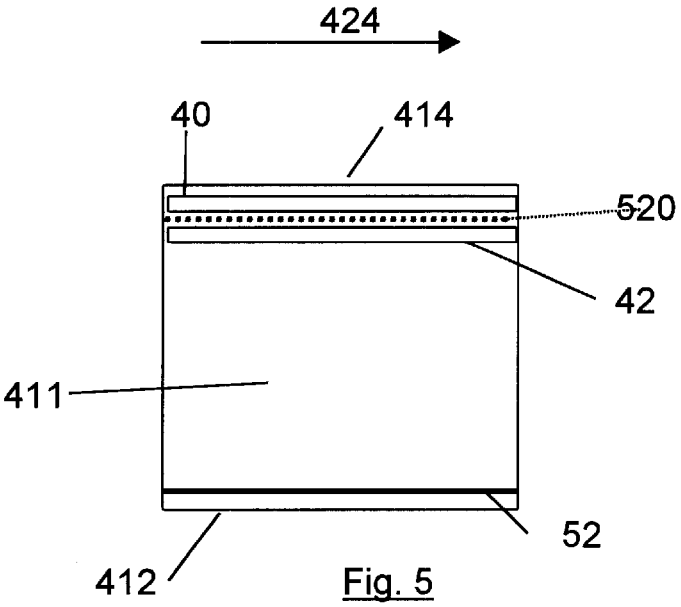
FIG. 5 is a bottom view of the hip and ridge shingle shown in FIG. 3.
Figure 4:
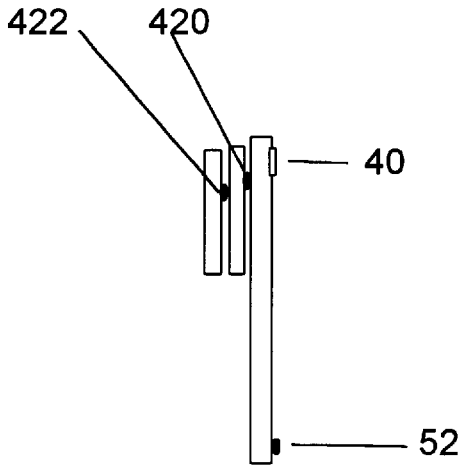
FIG. 4 is a side view of the hip and ridge shingle shown in FIG. 3.
Figure 6:
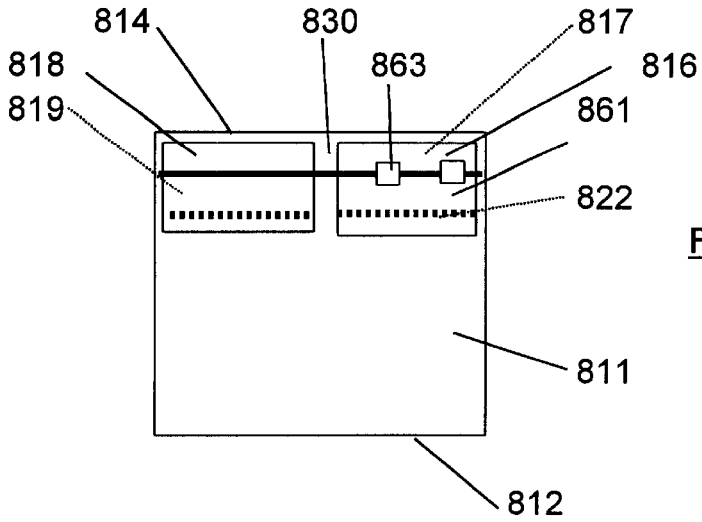
FIG. 6 is a plan view of an alternative embodiment of a hip and ridge shingle according to the present invention.
Figure 8:
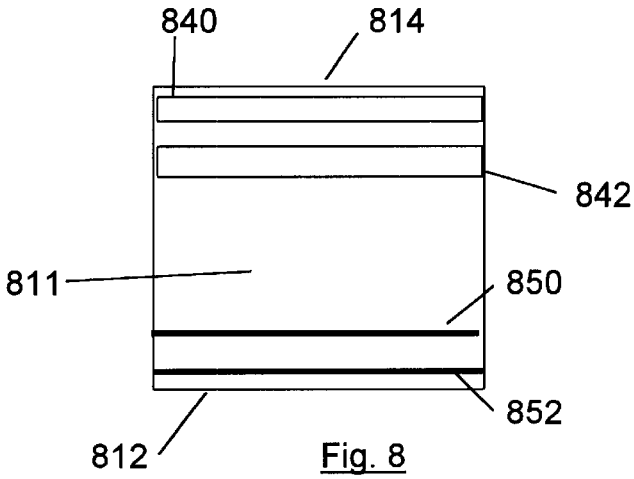
FIG. 8 is a bottom view of the shingle shown in FIG. 6.

A first embodiment according to the present invention is illustrated in FIGS. 3 through 5. In FIG. 3, a shingle 412 includes a base sheet 411 having a plurality of chips 416 through 419 secured thereto. In this embodiment, a first pair of chips 417, 419 are illustrated as being substantially coextensive with the second pair of chips 416, 418, but one skilled in the art appreciates that the first pair 417, 419, could alternately be a single chip like that shown in FIG. 1A, the single chip affixed to the base sheet with a short adhesive bead parallel to one edge of base sheet 11 similar to the attachment of the first panel 17 or chip 16 in FIG. 1A.

The chips 416 through 419 are adhered to the base sheet 411 in a manner similar to that described with reference to FIGS. 1 and 2, but in the illustrated embodiment, both adhesive beads 420, 422 are parallel and adjacent the trailing edge 414. Preferably the base sheet 411 comprises a known type of asphalt shingle having dimensions of about 1 foot by 1 foot square. Each of the chips 416–419 preferably comprise a rectangular piece of asphalt shingle approximately 4"×5", secured with a MLA adhesive bead of about 3/16" to ¼". As shown here, the beads 420 and 422 are parallel and overlap, preferably by one half or less of the width of each bead 420, 422. The overlap creates a bulge of adhesive within the gap 430. During installation, the bulge of adhesive may contact an adjacent shingle, which may enable adhesion to an adjacent shingle.

Figure 7:
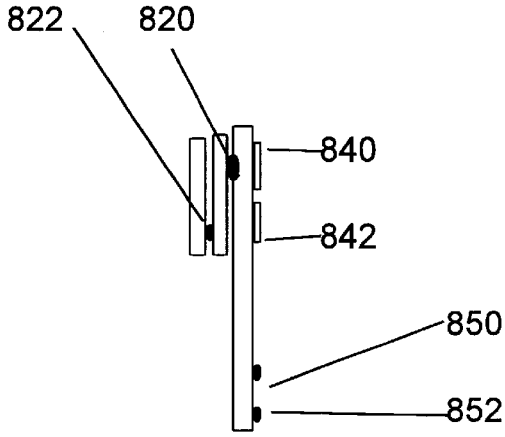
FIG. 7 is a side view of the shingle shown in FIG. 6.

Viewed from the bottom of the shingle as illustrated in FIG. 5, a sealant bead 52 is applied to the sheet 411 at the leading edge 412 of the shingle. Preferably this sealant comprises CRAFCO 34568, or equivalent sealant, having a bead width of ¼". In a preferred embodiment, the bead 50 comprises a pair of beads (as illustrated in FIG. 7 as 850, 852). In a preferred embodiment using about a 1 foot square shingle, preferably a pair of sealant beads are provided about 3" apart, the first of which 852 is approximately ⅝" from the leading edge 812. To improve the release of adjacent shingles in a package, a known release film 40 is applied to the trailing edge 414 of the shingle 411 in a known manner for each bead 52. Accordingly, adjacent shingles may be packaged back to back such that the release film 40 is positioned in a location on the shingle corresponding to the sealant bead 52 of an adjoining packaged shingle and therefore the sealant beads will not adhere the shingles within the package.

The first pair of chips 416, 418 are positioned on the base sheet 411 preferably adjacent to the trailing edge 414, and preferably substantially coextensive therewith. Each second chip 417, 419 is spaced approximately ¼ inch from each side 426, 428 of the base sheet 411. The chips 416 through 419 are sized as described above such that a gap 430 remains between the chips 416 through 419 after being positioned on the base sheet 411 so as to permit bending of the base sheet 411 over a ridge or within a valley.

During manufacture of the shingle, the base sheet 411 is preferably moved longitudinally along the length of the leading and trailing edges 412, 414 as indicated in FIG. 5 by arrow 424. Thus, the beads 420, 422 may be applied using a fixed nozzle positioned over the moving sheet 411, and the chips 416–419 are applied as the base sheet 411 moves along in a manner known to one skilled in the art. Alternatively, the sheet 411 may move in a manner perpendicular to the arrow 424 and the beads 420, 422 are applied with an applicator that traverses the width of the base sheet 411.

Figure 9:
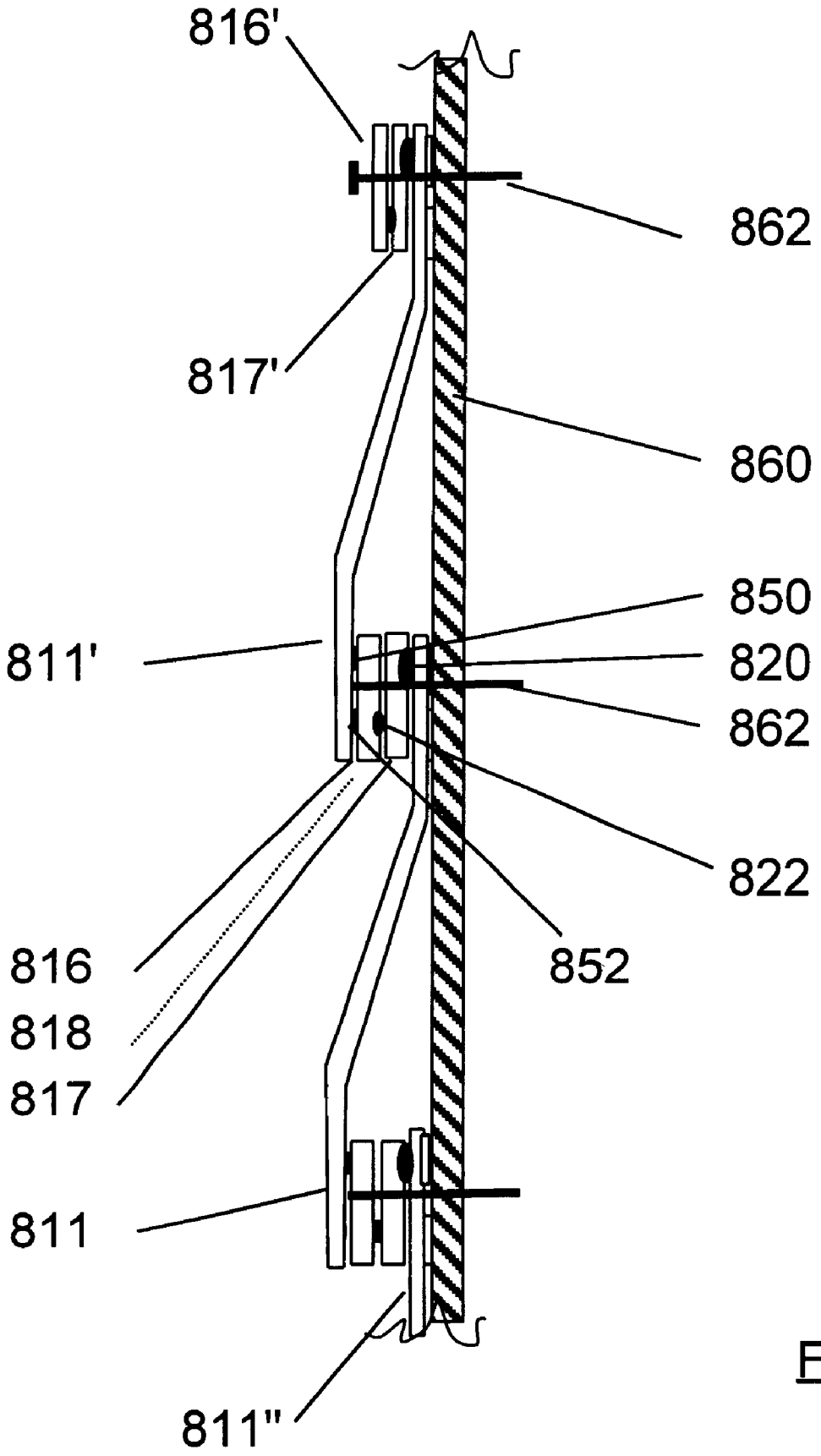
FIG. 9 is a partial sectional side view of shingles shown in the FIGS. 6–8 installed on a roof.

In an alternative embodiment shown in FIGS. 6 through 9, a shingle similar to that illustrated in FIGS. 3 through 5 is provided. However, the MLA adhesive beads 820, 822 provided to secure the chips 816 through 819 are spaced apart from the leading edge 814, instead of the substantial overlap provided in FIGS. 3–5. In this embodiment, the MLA adhesive beads 820, 822 are about ⅛ to 3/16 of an inch wide and spaced about 3 inches apart as measured along the 4" dimension of the chips from the trailing edge 814. The adhesive beads 850, 852 are as described above within the description of the embodiment shown in FIGS. 3 through 5. Preferably, as shown in FIG. 9, at least one of the sealant beads 850, 852 substantially aligns with one of the adhesives beads 820, 822 so that in addition to sealing to the chips 816, 818, the sealant 850, 852 will adhere to an adjacent base sheet 811 through the adhesive beads 822 after the shingles are installed on a roof. As described above, a release film 840, 842 is provided adjacent the trailing edge 814 to prevent shingles from sticking during shipment. Preferably the release film is not removed from the shingle, but installed to the roof therewith.

FIG. 9 illustrates a partial side view of a roof ridge having shingles installed according to the present invention. Accordingly, a pair of shingles 811, 811' are installed on a roof deck 860 as known to one skilled in the art. A portion of a third shingle 811" is illustrated. Although not shown here, a roof felt or a shield or other such intermediate layer is preferably provided between the deck 860 and shingles 811 as known to one skilled in the art. A plurality of nails illustrated at 862 are secured through the chips 816, 817 and the base sheet of the shingle 811 to secure the shingles to the roof deck 860. When a second shingle 811' is installed over a first shingle 811, the sealant beads 850, 852 adhere to the pair of second chips 816, 818 as discussed above, in this embodiment corresponding to the chips 816, 818. As described above with reference to FIGS. 6 through 8, the sealant beads 850, 852 may adhere to the exposed portions of adhesive beads 820, 822 and provide a direct load transfer route from shingle 811' to shingle 811. Preferably, two nails 862 are installed through each chip 816, 818 as indicated schematically in FIG. 6 on chip 816 as nail locations 861 and 863. Preferably the first location 816 is about ¾ to 1 inch from the edge 842 and the second location 863 is about 2–3 inches further from the edge 842. In an alternate embodiment, a single nail 862 may be installed through each chip at the first location 861. Wind testing of hip & ridge shingles described above utilizing UL 997-part 1 protocol has demonstrated satisfactory wind performance of the shingle illustrated in FIGS. 3 through 5 up to about 80 mph steady state winds using two nails per shingle. The shingle illustrated in FIGS. 6 though 8 using four nails has shown satisfactory wind performance to a steady state wind velocity of 110 mph (the maximum wind velocity available for testing).

Figure 10:
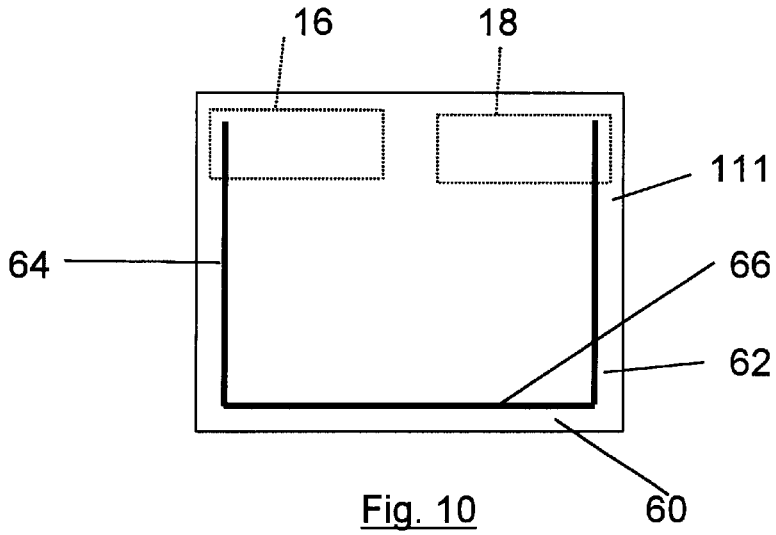
FIG. 10 is a bottom view of an alternative embodiment of a hip and ridge shingle according to the present invention.

A further embodiment is shown in FIG. 10, wherein a sealant bead 60 is applied to the base sheet 111 in a substantially U-shape. Accordingly, a pair of side beads 62, 64 are provided between the leading edge and the trailing edge and a lateral bead 66 is provided adjacent to trailing edge of the shingle. One skilled in the art appreciates that the side beads 62, 64 although shown intersecting the lateral bead 66, may terminate prior to intersecting the lateral bead 66.

Figure 11:
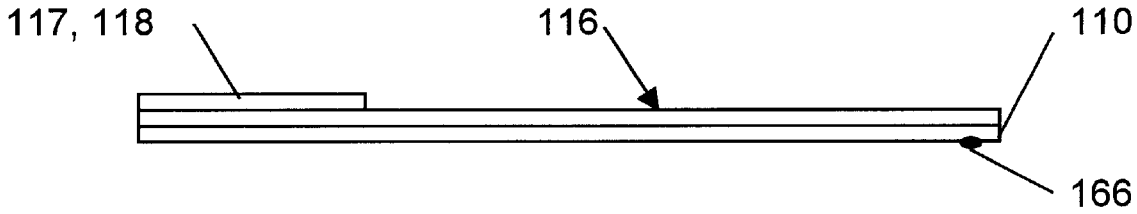
FIGS. 11–13 are side views of further alternative embodiments of hip and ridge shingles according to the present invention.
Figure 12:
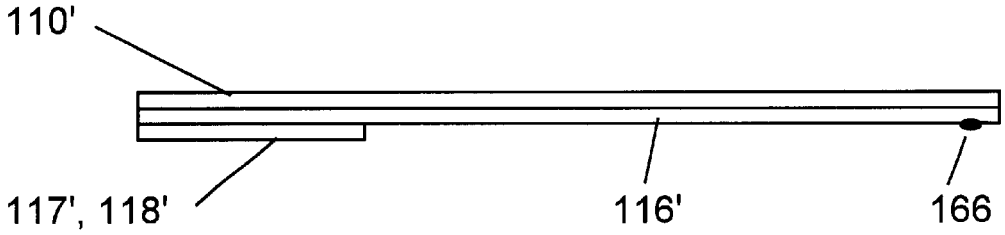
Figure 13:
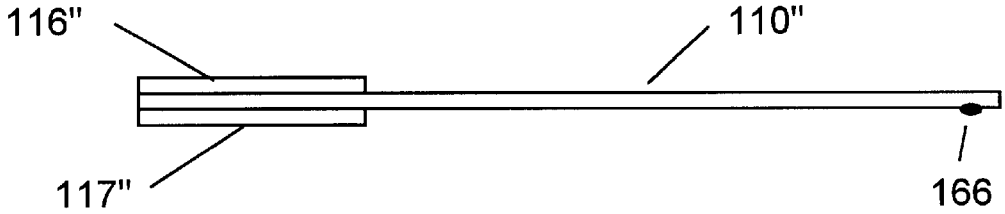

As shown in FIGS. 11–13, the principles of this invention may be applied to many hip and ridge shingle configurations, some further examples of which include a base sheet 110 having a first chip 116 adhered on one side thereof to the base sheet 110. A pair of chips 117, 118 are adhered to the top of the first chip 116. As shown in FIG. 11, the chip 116' may be adhered to the bottom of the base sheet 110' and the second chips 117, 118 adhered to the bottom of the first chip 116' (or chips as shown in prior Figures). Finally, FIG. 13 illustrates the base sheet 110" having one or more chips 116", 117" adhered to each the top and bottom thereof. In each of these embodiments, one or more lateral beads 166 are provided on the bottom side of the shingle as described above with reference to the other Figures.

Furthermore, one skilled in the art appreciates that the present invention may be applied to a number of other hip and ridge shingle configurations, such as provided in U.S. Pat. No. 5,271,201 or U.S. Pat. No. 4,835,929, which are incorporated herein by reference, or any others hip and ridge design. One skilled in the art appreciates the sealant bead described above could be applied to other such designs and therefor provide the benefit of additional wind resistance and thereby prevent lift off of the base sheet from the roof. Additional examples include hip and ridge shingles of a non-laminated design, as well as laminated designs with one thickness of risers (versus the two illustrated in the Figures).

The principle of this invention has been described in the preferred embodiment provided above. However, one skilled in the art appreciates that this invention may be practiced otherwise then as specifically illustrated and is described herein without departing from the scope of the claimed invention.

What is claimed is:

1. A hip and ridge shingle comprising:

a base sheet having a leading edge and a trailing edge, a top surface and a bottom surface, and colored granules adhered to the top surface thereof; and a chip adhered to the base sheet on a surface selected from one of the top and bottom surface at the trailing edge of the base sheet, the chip comprising a pair of risers, a first riser of each pair being secured to the base sheet adjacent a first side of the base sheet and the second riser being secured to the base sheet adjacent a second side of the base sheet, thereby providing a gap between the two risers on the base sheet.

2. A hip and ridge shingle according to claim 1, further comprising said base sheet having a pair of lateral sides extending from the leading edge toward trailing edge of the base sheet, and a second sealant bead applied to the base sheet on the selected surface thereof adjacent one of the sides of the base sheet, and a third sealant bead applied to the base sheet on the selected surface thereof adjacent the other of the sides of the base sheet.

3. A hip and ridge shingle according to claim 1, wherein said risers are substantially rectangular.

4. A hip and ridge shingle according to claim 1, wherein the chip further comprises third and fourth risers secured to the first and second risers respectively and substanually coextensive therewith.

5. A hip and ridge shingle according to claim 4, wherein the first and second risers are secured to the shingle using a first bead of adhesive and the third and forth risers are adhered to the first and second risers, respectively, using a second adhesive bead, both of said beads being applied to the risers in a substantially parallel overlapping condition.

6. A hip and ridge shingle according to claim 5, wherein the chips are secured to the top surface of the base sheet and one of the sealant beads from a first shingle is adhered to the adhesive bead on the bottom surface of an adjacent second shingle when a pair of shingles are secured to a roof.

7. A hip and ridge shingle according to claim 4, wherein the first and second risers are secured to the top surface of the base sheet using a first bead of adhesive and the third and forth risers are adhered to the first and second risers, respectively, using a second bead of adhesive, the second adhesive bead being applied to the risers in a parallel condition to the first adhesive bead.

8. A hip and ridge shingle according to claim 7, further comprising a second sealing bead provided parallel to the first sealant bead and spaced therefrom adjacent the leading edge of the base sheet on the selected surface thereof, wherein the adhesive beads of a first shingle adhere to the sealant beads on a second shingle when the shingles are installed on a roof.

9. A shingle according to claim 1, wherein the wherein the first and second risers are secured to the top surface of the base sheet and the sealant bead is applied to the bottom surface of the base sheet, the shingle further comprising a film applied to the bottom surface of the shingle adjacent the trailing edge such that when two shingles are positioned in a package with the bottom surfaces face to face and the leading edge of a first shingle adjacent the trailing edge of a second shingle, the sealant bead contacts the film.

10. A hip and ridge shingle according to claim 1 further comprising a sealant bead provided on a surface of the base sheet selected from one of the top and bottom surface of the base sheet parallel to and adjacent the leading edge thereof.

11. A hip and ridge shingle according to claim 10 further comprising a second sealing bead provided parallel to the first sealant bead and spaced therefrom adjacent the leading edge of the base sheet on the selected surface thereof.

12. A sloped roof having resistance to high winds, the roof having a roof deck with an intersecting plane forming a hip or ridge at which a series of shingles are each secured to the roof deck along the entire length of said intersecting planes the roof comprising:

a plurality of hip and ridge shingles, each shingle having a base sheet with a leading edge and a trailing edge, a top surface and a bottom surface, and colored granules adhered to the top surface thereof, the shingles being applied to a roof in a partially overlapping condition; and a chip adhered to each of the base sheets on a surface selected from one of the top and bottom surface at the trailing edge of the base sheet, the chip comprising a pair of risers, a first riser of each pair being secured to a respective one of the base sheets adjacent a first side of the base sheet and the second riser being secured to the respective base sheet adjacent a second side of the base sheet, thereby providing a gap between the two risers on the base sheet.

13. A roof according to claim 12, wherein said risers are substantially rectangular.

14. A roof according to claim 12, further comprising each of said base sheets having a pair of lateral sides extending from the leading edge toward the trailing edge of the base sheet, and a second sealant bead applied to the base sheet on the selected surface thereof adjacent one of the sides of the base sheet, and a third sealant bead applied to the base sheet on the selected surface thereof adjacent the other of the sides of the base sheet, the second and third sealant beads adhering the sides of first and second shingles.

15. A roof according to claim 12, wherein each of the chips further comprises third and fourth risers secured to the first and second risers, respectively, and substantially coextensive therewith.

16. A hip and ridge shingle according to claim 15, wherein each of the first and second risers are secured to the respective base sheet with a first bead of adhesive and each of the third and forth risers are adhered to the respective first and second risers, with a second adhesive bead, both of said beads being applied to the risers in a substantially parallel overlapping condition.

17. A roof according to claim 16, wherein the respective chips are secured to the top surface of the respective base sheet and one of the sealant beads from the first shingle is adhered to the adhesive bead on the bottom surface of the second shingle when the shingles are secured to the roof, the leading edge of each successive shingle substantially covering the chip of the preceding shingle.

18. A roof according to claim 15, wherein each of the shingles are secured to the roof using two nails, each nail being driven through two overlapping risers and the base sheet.

19. A roof according to claim 15, wherein the first and second risers are secured to the top surface of the respective base sheet using the first bead of adhesive and the third and forth risers are adhered to the first and second risers, respectively, using the second bead of adhesive, the second adhesive bead being applied to the risers in a parallel condition to the first adhesive bead.

20. A roof according to claim 19, further comprising a second sealing bead provided on the bottom surface of each base sheet parallel to the first sealant bead and spaced therefrom adjacent the leading edge of the base sheet, wherein the adhesive beads of the first shingle adhere to the sealant beads on the second shingle when the shingles are installed on the roof.

21. A roof according to claim 20, wherein each of the shingles are secured to the roof using four nails, one nail being driven through two overlapping risers and the base sheet adjacent one side, a second nail being driven the same two overlapping risers and base sheet spaced from the first nail toward the second side, a third and a fourth nail being driven through the other two risers, the third nail being positioned adjacent the second side and the fourth nail spaced from the third nail toward the first side.

22. A roof according to claim 12 further comprising a sealant bead provided on each of the base sheets parallel to and adjacent the leading edge thereof on a surface opposite the surface to which the chip is adhered, the sealant bead adhering the base sheet of the first shingle to the chip on the second shingle.

23. A roof according to claim 22 further comprising each shingle having a second sealing bead provided parallel to the first sealant bead and spaced therefrom adjacent the leading edge of the base sheet on the selected surface thereof, the second sealing bead further adhering the base sheet of the first shingle to the chip on the second shingle.

* * * * *

UNITED STATES PATENT AND TRADEMARK OFFICE

CERTIFICATE OF CORRECTION

PATENT NO. : 6,494,010 B1
DATED : December 17, 2002
INVENTOR(S) : Brandon

It is certified that error appears in the above-identified patent and that said Letters Patent is hereby corrected as shown below:

Column 5,
Line 36, “substanually” should be -- substantially --.

Column 6,
Line 16, “planes” should be -- plane --.

Signed and Sealed this

Twenty-sixth Day of August, 2003

JAMES E. ROGAN
*Director of the United States Patent and Trademark Office*